United States Patent [19]

Townsend

[11] Patent Number: 4,997,028

[45] Date of Patent: Mar. 5, 1991

[54] ROTARY HEAT EXCHANGER WITH SEGMENTED SEALS

[76] Inventor: Garnold Townsend, P.O. Box 232, Waterford, Ohio 45786

[21] Appl. No.: 341,136

[22] Filed: Apr. 20, 1989

[51] Int. Cl.[5] ..... F28D 19/00

[52] U.S. Cl. ..... 165/9; 165/8

[58] Field of Search ..... 165/9, 8

[56] References Cited

U.S. PATENT DOCUMENTS

| | | | |
|---|---|---|---|
| 2,055,071 | 9/1936 | Eriksson | 165/9 |
| 2,607,565 | 8/1952 | Jensen | 165/9 |
| 3,773,105 | 11/1973 | Kondo | 165/9 |
| 4,024,905 | 5/1977 | Guillot | 165/9 |
| 4,084,634 | 4/1978 | Handa | 165/9 |
| 4,212,472 | 7/1980 | Mizuno et al. | 165/9 |

*Primary Examiner*—Albert W. Davis, Jr.

*Attorney, Agent, or Firm*—Steele, Gould & Fried

[57] ABSTRACT

A segmented seal is disposed between a rotary heat-retaining body and its housing, the housing defining a hot flow path and a cool flow path through the housing and intersecting the heat retaining body, and the heat retaining body being movable to transfer heat from one flow path to the other. A plurality of serially-connected seal segments are attached to one of the body and the housing, the seal segments each extending along a seal line and overlapping one another along the seal line, the seal segments bearing against the other of the body and the housing to effect a seal.

20 Claims, 3 Drawing Sheets

Fig. 6.
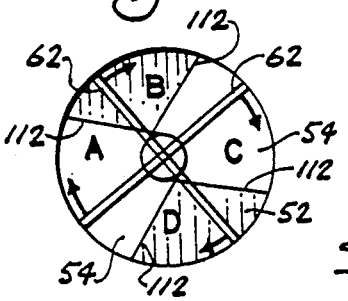
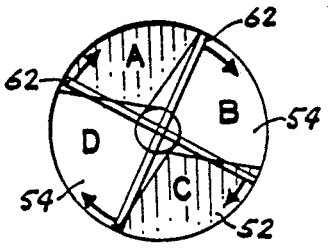
Fig. 7.
Fig. 8.
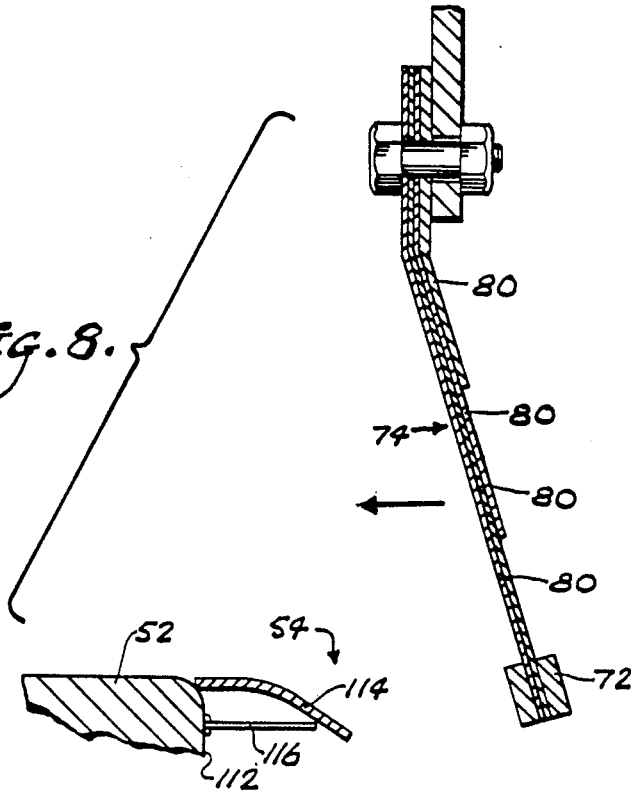
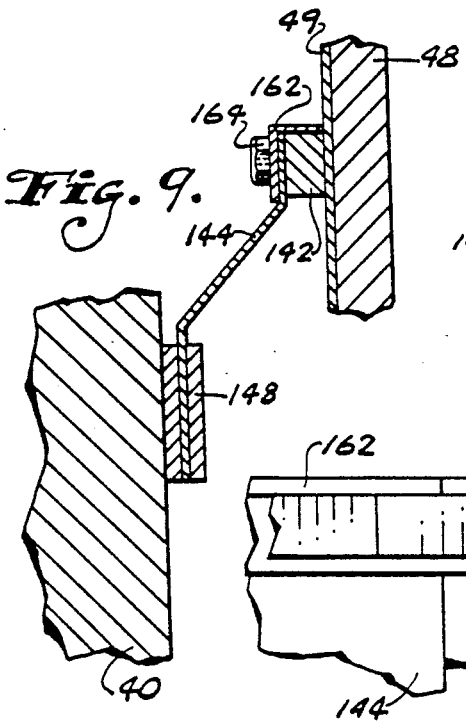
Fig. 9.
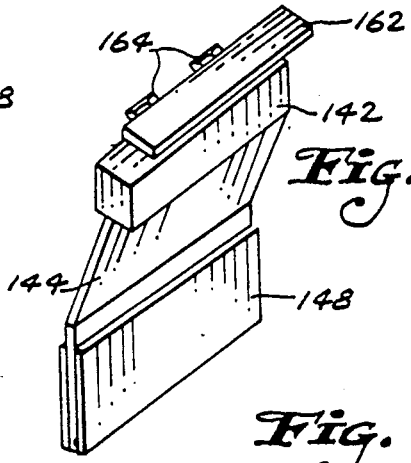
Fig. 10.
Fig. 11.
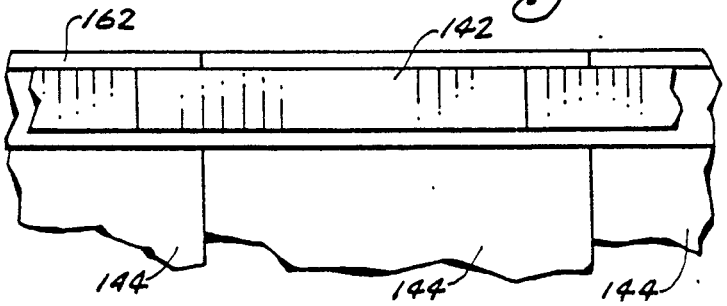

ROTARY HEAT EXCHANGER WITH SEGMENTED SEALS

BACKGROUND OF THE INVENTION

1. Field of the Invention

This invention relates to the field of heat exchangers, and in particular to a rotary regenerative heat exchanger having a particular construction of radial and/or circumferential seals.

2. Prior Art

In a conventional regenerative heat exchanging apparatus, a hot gas conduit, for example the exhaust of a fuel burning power plant, is routed alongside a cool gas conduit, for example the combustion air inlet to the plant. At one or more points along the path of the conduits, a movable heat exchanging body is disposed such that the hot gases can be passed through the heat exchanging body, which collects heat. The heat exchanging body is moved, for example by rotating it, such that the cool inlet gas is passed through heated portions of the body to extract the heat which was collected. Typically, the heat exchanging body is a cylindrical arrangement of sheet material, for example lengths of corrugated sheet metal wrapped in a roll about an axis around which the cylinder is to be rotated. The cylinder is typically subdivided into angular sectors by means of radial plates extending the axial length of the cylindrical body such that the gases passing through the cylindrical body are confined to one radial sector and cannot leak between the hot and cool sides. Similarly, structures defining the hot gas passage through the stationary housing in which the cylinder turns, and also the cool gas passage, also define angular sectors. When an angular sector as defined by plates of the cylindrical heat exchanging body aligns with the angular sector of the hot or cool passage, respectively, then gases pass through that sector.

The radially-extending plates of the heat exchange body are frequently sealed at the axial ends of the heat exchange body to the housing in which the heat exchange body turns. In this manner, intake air cannot leak from the air side to the gas side by passing around the outside of the heat exchanging body. There are numerous examples of different types of seals in the prior art, including, for example U.S. Pat. No. 4,098,323-Wiegard et al, disclosing axially-extending circumferential seals. U.S. Pat. No. 3,011,766-Hess discloses inner and outer radially-directed seals in a toroidal heat exchanger.

Cylindrical body heat exchangers with seals bridging from cylindrical bodies to their housings are disclosed for example, in U.S. Pat. Nos. 4,383,573-Wincze; 3,822,739-Kurschner; 3,545,532-Waitkus; 3,380,514-Eisenstein; 3,216,486-Hall et al; 3,182,715-Rayburn; 2,945,681-Burchfield; 2,692,760-Flurschutz; 2,549,656-Yerrick et al; 1,522,825-Ljungstrom; 1,746,598-Ljungstrom; 2,287,777-Boestad; 2,517,512-Tigges et al; 4,673,026-Hagar et al; 2,549,583-Eckersley; and 4,791,980-Hagar et al. The disclosures of all said patents are hereby incorporated.

Substantial difficulties are encountered in attempting to adequately seal between the cylindrical heat exchange body and the housing in which it rotates. The environment of combustion exhaust gases is corrosive and abrasive. Seals which bear in this environment against the cylindrical body from the housing, or vice versa, tend to be worn down quickly. Another problem is encountered in that heating and cooling of the heat exchange body produce thermal stresses causing the heat exchange body to warp or sag with variations in temperature, and affecting the clearance between the body and the housing, i.e., the dimensions of the space to be bridged by the seals Where, for example, a heat exchange body is expected to rotate on a vertical axis deformation of the cylindrical heat exchange body with heating may take the form of axial displacement at the circumference of the heat exchange body, the heat exchange body sagging to resemble the form of a truncated cone. Of course, should the seals be dimensioned to accommodate a precisely cylindrical arrangement, the lower seals will be quickly worn down and the upper seals may define a gap with respect to the top of the housing.

The foregoing prior art references attempt a number of seal arrangements in an effort to accommodate these very demanding conditions. Spring biased displaceable seal elements, magnetically displaceable seal elements, telescopically displaceable seal elements and other variations all appear in the prior art. However, more and more complicated mounting and/or displacement configurations for the seals, cause greater and greater problems due the abrasive nature of the environment interfering with correct operation of the seals. In such an abrasive and corrosive environment, simpler seals may be longer lived. On the other hand, simpler seals are more difficult to adapt to the variations in the span of the seal which are required to maintain a seal.

Where a longer lived seal is desired, it may seem appropriate to provide a heavier seal body such that abrasion will take longer to wear away the seal in the required dimension. A thicker seal, however, is likely to be even less flexible and therefore may be less able to accommodate dimensional variations which occur at operating temperatures.

A further problem encountered in the prior art relates to the replacement of worn seals. Any seal will eventually deteriorate and must be replaced. When refurbishing the seal, it is necessary to determine precisely where the radial and/or circumferential seals to be replaced should be optionally mounted with respect to the housing. It is normally not possible for maintenance personnel to access the heat exchanger in its operative condition, when high temperatures and fumes are present. As a result, it is necessary to estimate the correct position of the seals when replacing the wear surfaces thereof. The seals are inherently flexible and displaceable, and as a result it is most difficult according to the prior art to correctly position the seals. Too often, seals are inadvertently set at a wrong clearance, the seals being quickly worn off and/or the efficiency of the heat exchanger being lost by widely gapped seals.

Regenerative heat exchangers have been effective to conserve energy by usefully extracting excess heat. As a practical matter, however, a number of problems remain which make it difficult or impossible according to the prior art to enjoy the full potential efficiency of a regenerative heat exchanger. The present invention solves a number of the practical problems associated with sealing the heat exchanger, including problems with respect to wear, flexibility, replacement and correct mounting of the radial and circumferential seals.

SUMMARY OF THE INVENTION

It is an object of the invention to provide flexible wear-resistant replaceable seals for a regenerative rotary heat exchanger.

It is another object of the invention to provide an overlapping segmented seal with reinforcing shoes for thickening the wearing edge of the seal, without undue loss of flexibility.

It is another object of the invention to provide easily replaceable seals which can be positioned accurately notwithstanding dimensional fluctuations and displacements occurring with thermal cycling.

These and objects are accomplished by a segmented seal disposed between a flow-passing rotary heat-retaining body and its housing, the housing defining a hot flow path and a cool flow path through the housing and intersecting the heat retaining body, the heat retaining body being movable to transfer heat from one flow path to the other. A plurality of serially-connected seal segments are attached to one of the body and the housing, the seal segments each extending along a seal line and overlapping one another along the seal line, the seal segments bearing against the other of the body and the housing to effect a seal.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein:

FIG. 6 and 7 are schematic axial views showing interaction of the radial sector seals and the edges of the sector openings.

FIG. 8 is a detailed section view showing interaction of a seal segment and the edge of a sector opening.

FIG. 9 is a partial section view showing the interaction of a circumferential seal (or "end seal") according to the invention and the heat exchanger housing.

FIG. 10 is a section view of a single segment of the circumferential seal according to FIG. 9

FIG. 11 is a partial elevation view showing a series of lapped segments according to FIG. 10.

DETAILED DESCRIPTION OF THE PREFERRED EMBODIMENTS

Figure 1:
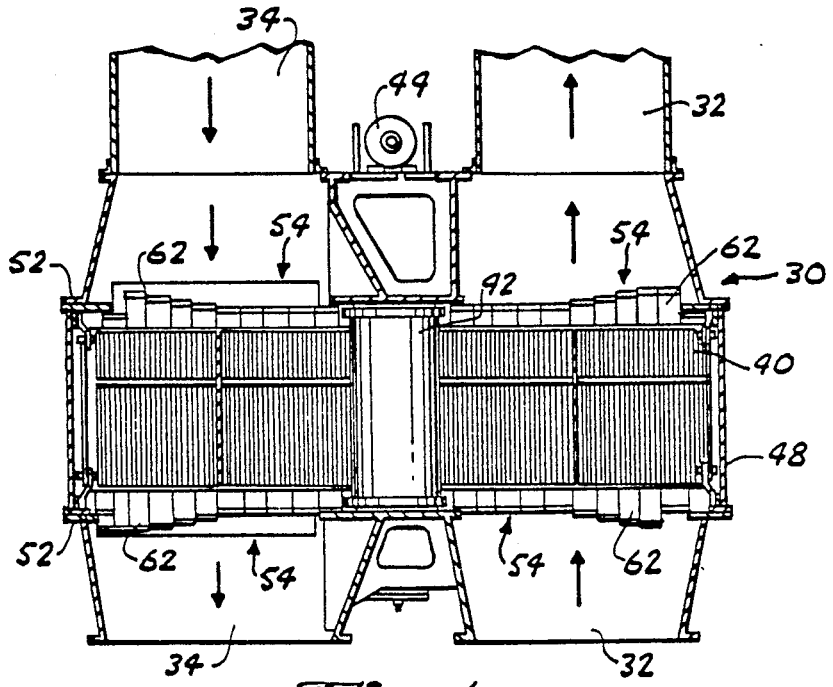
FIG. 1 is a section view through a rotary heat exchanger according to the invention.

A regenerative heat exchanger 30 is shown in FIG. 1. Hot gases passing along duct 32 of heat exchanger 30 carry waste heat away from a process such as a combustion process in a power plant, the object of heat exchanger 30 being to extract excess heat energy from gas passing through duct 32. This heat is carried around an axis defined by central shaft 42 to another duct 34, along which cool air is passing, for example the inlet air to the combustion process, where the heat is released into the inlet air and improves overall combustion efficiency. The heat exchange cylinder 40, which may be a plurality of corrugated fins or the like wrapped around shaft 42, is rotated by means of motor 44. The rotational speed can vary, as known in the art, to accommodate the flow rates and temperatures expected.

Heat exchangers are often used in connection with combustion processes. However, heat exchangers including the present invention have other applications apart from combustion processes, as known in the art. The invention is therefore believed applicable to any heat exchanger environment.

The heat exchange body carries only heat energy. Any hot-side air or gas, e.g., combustion exhaust with accompanying combustion byproducts, is to be isolated on the exhaust side. Therefore, the inlet and exhaust sides are isolated from one another but heat energy is moved between them.

The heat exchange body is preferably a cylinder. Heat exchange cylinder 40 resides, with minimum clearance, in a substantially cylindrical housing 48, which is closed all around heat exchange cylinder 40, except for the inlet and outlet ducts 32, 34. The inlets and outlets can be sector shaped openings i.e., defining an angular segment (e.g., 40°) of a circular arc in circular plates 52 defining the top and/or bottom of housing 48.

The heat exchange cylinder 40 is also provided with internal partitions which divide the heat exchange body 40 into segments which may or may not correspond to the angular segments defined by ducts 32, 34. These partitions, which extend along a radius of heat exchange cylinder 40, and parallel to the longitudinal axis of body 40 prevent gases in one of the two ducts 32, 34 from passing diametrically through the body of heat exchange cylinder 40, to the other side. Typically, the heat exchange body 40 also has partitions running at other directions, for example circumferential partitions spaced at a plurality of radii from central shaft 42 whereby heat exchange body is structurally supported and air flow paths which depart from a direct path along duct 32 or along duct 34 are precluded.

The heat exchanger body 40 is a partial obstruction along both the hot and cool flowpaths. Accordingly, a pressure differential occurs across the housing 48 and/or heat exchange body 40. Powered means (not shown) such as fans force either or both of cool air through the inlet and hot gas through the outlet. Flow through the outlet can sometimes be driven by thermal action. In any event, leakage is prone to occur absent adequate isolation of the hot and cool sides.

It is necessary to seal between the edges of heat exchange body 40 and the substantially cylindrical housing 48, in which heat exchange body 40 rotates. The housing 48 is tubular on its circumferential outside and has circular plates 52 at the axial top and bottom, plates 52 being interrupted by at least two sector openings 54 in circular panels 52, the sector openings 54 for example corresponding with the ducts 32, 34. In order to effect sealing, radial seals 62 are mounted on body 40 to bear axially upwardly and downwardly along a radius of heat exchange body 40, a free end of the seals 62 bearing against circular plates 52. Radial or sector seals 62 typically correspond with radial partitions in body 40. As body 40 rotates, the radial sector seals 62 slide along the surface of circular plates 52, dropping into the area defined by the sector opening 54, when reaching the angular position thereof, and resiliently bending back upon meeting the far edge of sector opening 54, where the seal bends back and must again slide over the surface of circular panel 52. Radial sector seals 62 prevent gas from passing between a gap otherwise defined between the axial end faces of heat exchange cylinder 40 and the circular panels 52 defining the space therefor.

It is also necessary to seal against gases which might simply bypass the heat exchange body 40 while remaining on the gas or air side. This is accomplished using circumferential seals 66, which bear radially outwardly or inwardly, all around the circumference at the axial cold and hot ends, of cylindrical heat exchanger 40. The radial seals can bear axially against end plates 52 on both the hot or cold ends of heat exchangers 48. In either case, the effect is to block gas passing around the annular gap between heat exchange body 40 and housing 48 or near bar 49. Wear bar 49 as shown in FIG. 9 can be an abrasion resistant element attached on an inner wall of housing 48 in the area of contact with the seal.

It will be appreciated that the seals between body 40 and housing 48 can be attached on either the housing or the body, and slidable on the other. Accordingly, the description herein, which is primarily concerned with the seals being attached to body 40, should also be construed to include the comparable situation where the seals are attached to the housing. This description also primarily discusses heat exchangers which rotate on a vertical axis, and therefore have the greatest dimensional variation with temperature cycling. Nevertheless, the seals of the invention are fully applicable to heat exchangers which rotate on some other axis, e.g., a horizontal axis, and to devices which move in some other manner to transfer heated structures from a hotter side to a cooler side, for example belt-like heat exchange bodies and the like, receprocating heat exchange bodies, etc.

The interaction between the radial or sector seals 62 and the circular plates 52, particularly at the edges of sector openings 54, is arranged such that the radial sector seals 62 and the edge of sector opening 54 are not precisely aligned. For example, one of the seal 62 and the sector edge is precisely radial and the other is not radial. The sector seal and the edge therefore never linearly correspond all along the seal as the seal passes the edge of the sector opening. This is illustrated schematically in FIGS. 6 and 7. As the radial seals 62, corresponding to divisions between sectors of the heat exchanging cylinder 40, rotate with body 40 and move with respect to the fixed circular panel 52 and the angular segment sector openings 54 therein, the edges 112 of the sector openings are intersected by seals 62 at a point rather than a line. The intersection point proceeds radially outwardly (or inwardly) as body 40 rotates. This is the case because one of the contacting lines, i.e., either the edges 112 of the sector openings 54 or the sector seals 62, is not precisely radial while the other is radial. In the illustrated embodiment, seals 62 are radial but edges 112 are each parallel to a radius but spaced therefrom. The lines defined by seals 62 and edges 112 therefore cross but never precisely correspond as the body 40 rotates and seal 62 edges over the boundary 112. In FIG. 6, the seal 62 is shown substantially displaced from the edges 112 of openings 54. In FIG. 7, the seals 62 correspond substantially to the positions of the sector openings 54, however, even in this position, the seals 62 do not linearly correspond with the edges of the sector openings. In FIGS. 6 and 7 only four sectors are defined between radial seals 62. It will be appreciated that any number of sectors can be provided, with the normal number being 12, regardless of size or model of the heat exchanger.

As a result of the arrangement whereby seal 62 contacts edge 112 along a moving point, the seal must be flexible. A segmented seal is thus appropriate for added flexibility. On the other hand, a segmented seal suggests leakage due to inter-segment gaps and is normally inconsistent with mounting enlarged wear-resisting edge members on the seal.

The environment within the ducts 32, 34 and in particular the environment within the exhaust duct 32, is both corrosive and abrasive due to the combustion byproducts and grit passing along the exhaust. As shown in FIGS. 2–5, with respect to the radial seal and in FIGS. 9–11 with respect to the circumferential seal, the device of the invention has a relatively thick shoe at the free end of seal, namely at the portion which bears against the cylindrical housing 48 or wear bar 49.

A plurality of seal segments overlap one another, the wear shoes for each segment being provided on both opposite sides in the radial seal and staggered such that the sector leaf element which carries the wear shoe can overlap an adjacent sector leaf segment, providing a substantially continuous seal surface as the seals ride along the inner surfaces of housing 48. In this circumferential seal, the wear shoes and segment leaves of successive segments engage.

Figure 4:
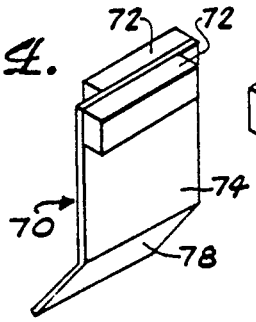
FIG. 4 is a perspective view of a single seal segment for a radial seal according to FIG. 2.

FIG. 4 shows an individual radial seal segment 70. A flat base portion 78 is integrally connected to a depending section leading to wear shoes 72 on both opposite sides of a free end of the segment 70. Preferably, the leaf portion 74 of the sector seal 70 is defined by a plurality of progressively-longer sheet layers, attached over one another such that the seal is stiffest at its mounting edge adjacent flat band 78, and is thinner and more flexible at its free end. The seal of the invention as a whole is much longer and stiffer than typical seals, nevertheless having more than adequate service life and good sealing characteristics by virtue of the overlapping segments leading to the wear shoes.

Each of the segments is attached along a sector partition in heat exchanger body 40 such that the seal as a linear matter extends radially or substantially radially (see FIGS. 6 & 7). The seal segments 70 will each be deflected more or less to the rear around the junction between flat 78 and the remainder of leaf 74, depending upon the spacing between heat exchanger body 40 and the circular panels 52 in which the sector openings 54 are defined. A plurality of bolts 76 attach the seal as defined by the lapped segments to the partition on the heat exchanger body 40, or preferably, to the base portion of a previously-installed and worn-out seal which the present seal replaces, as discussed more fully hereinafter. Whether the seal segments 70 are attached to the base of an old seal or to the partition directly, the seals extend from the partition such that the wear shoes 72 bear against the housing. It will be noted that wear shoes are provided on both sides of each segment, thereby providing quite a wide contact area between the seal 62 and the housing 52. While the individual segments are rendered quite rigid by the wear shoes 72, the overall seal as defined by the lapped segments of sheet material terminating in shoes 72, is relatively flexible and conforms readily to the varying dimensions of the inside of the housing 48.

Figure 2:
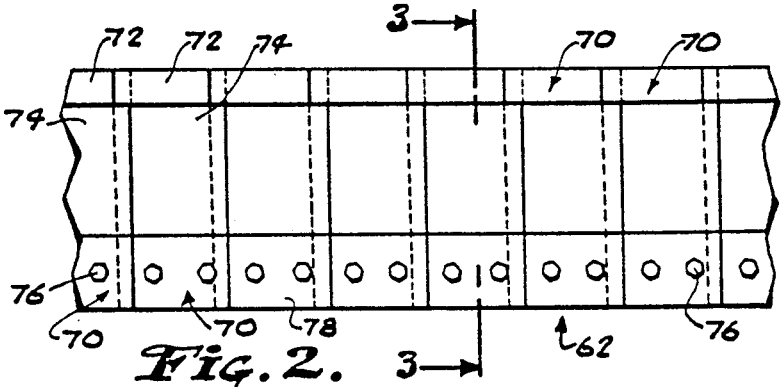
FIG. 2 is a partial elevation view of a radial seal (or "sector seal") according to the invention.
Figure 3:
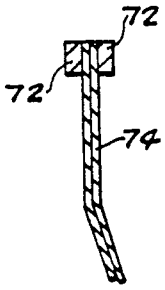
FIG. 3 is a section view taken along lines 3—3 in FIG. 2.
Figure 5:
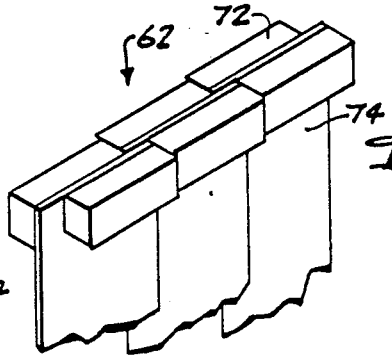
FIG. 5 is a partial perspective view of a series of lapped seal segments according to FIG. 4.

Shoes 72 on opposite sides of leaf 74 do not extend clear to the edge of the leaf on one of their respective side. As a result, the leaves can be lapped against one another as shown in FIGS. 2 and 5, with the shoes 72 endwise abutting one another while the leaf portions 74 overlap by a space substantially equal to the gap between the shoe 72 and the edge of the segment. This overlap is also shown in FIG. 3, as is the fact that shoes 72 extend in both opposite directions.

As shown in FIG. 8, preferably the radial seals are formed of a plurality of lapped individual layers, each extending somewhat farther from body 40 than the last layer, such that the seal is more rigid at its base, and less rigid adjacent the wear shoe. For example, in a preferred embodiment, the flat 78 at the connection edge of the radial seal 62 is provided with a weld bar, which may vary, in thickness, followed by a base leaf segment of thin flexible metal material, extending about a $\frac{1}{3}$ of the length of the leaf 74, with a second layer of similar thickness extending $\frac{2}{3}$ of said length immediately against the first layer. The longest section of the leaf, namely the parts supporting the wear shoe, can be thicker, and may vary in thickness according to size and model of air heater.

The individual plys for reinforcing and adding flexibility to the leaf, which are shown in FIG. 8, can be thin, flexible sections of corrosive resistant metal, which will vary in size. Typically, the radial seal will extend a linear length between the axis and circumferential seal and will seal a gap between rotor and sector plate 52, which varies with temperature conditions. The seals must withstand a pressure differential which will vary with size and model of the air heater. The individual segments can be, for example, on the order of 3 inches in width along the radius. The wear shoes, preferably wear-hardening stainless steel, can be 0.125 inches in thickness, or larger, as required for the particular application. Preferably, spot welds are used to attach together the wear shoes and individual layers of the seal leaf 74. In a typical fuel combustion application, the leaf layers can be as thin as several mils or as thick as twenty or more mils. A thinner seal is more effective for sealing due to its ability to conform to the surface it contacts. However, thinner seals wear out more quickly than thicker ones.

Normally, the shorter the seal length (i.e., the shorter the gap spanned by the seal), the stiffer the seal becomes. A stiff seal is expected to suffer relatively more from wear than a more flexible seal. This is especially true where the seal repeatedly strikes an obstruction along its circular route. However, longer seals are more susceptible to deflection with pressure differential. According to the present invention, the seal is rendered stiff by its wear shoe, which has the beneficial results of not only allowing the seal to withstand greater wear, but also providing a weight at the distal end that resists deflection with pressure.

FIG. 8 shows a section view of a segment of the radial seal 62, approaching the edge 112 of a sector opening 54. According to this embodiment, means are provided for effectively protecting the seal segment 70 from repeated impacts against the edge 112 of the sector opening 54. For this purpose, a curved ramp 114 is provided at the edge of the circular plate 52 leading out of the sector opening 54. Ramp 114, which has a smooth radius up to the level of circular plate 52, extends low enough into the sector opening 54 to guide the wear shoe 72 of the oncoming sector seal up onto the flat surface. As explained above with reference to FIGS. 6 and 7, one seal segment rides over ramp 114 at a time in the progressive point contact between the seal 62 and the edge 112. Ramp 114 is preferably a relatively short wear bar, for example having a 1.25 inch radius at the bend, extending only a short distance into the area of the sector opening 54, and therefore not substantially obstructing flow of air or hot gas. Ramp 114 can be supported from below by one or more supporting members 116, for example a flat bar welded along the length of ramp 114. When wear shoe 72 meets ramp 114, the seal is smoothly flexed to define a somewhat rounded configuration along leaf 74, with the greater curvature occurring where leaf 74 is thinner by virtue of having fewer superimposed layers 80, i.e., adjacent wear shoe 72.

A circumferential seal segment 140, having certain attributes in common with the sector seal 62 discussed above, is shown in FIGS. 9–11. In FIG. 9, the seal segment 140 making up circumferential seal 66 is shown in section, resiliently bearing radially outwardly against housing 48 and extending along a circle parallel to the circumference of the heat exchanger body 40. Circumferential seal segment 140 is affixed to body 40 by means of weld bar 148, clamped directly to body 40, or 48 with original mounting device. Extending from weld bar 148 is a flexible leaf segment 144, leading to wear shoe 142, carried at the free end of the seal and bearing against housing 48. It will be appreciated that the circumferential seal can be directed axially or radially (radially in the present embodiment), and can be mounted on the housing to seal against the heat exchanger body, or vice versa. In each case, the effect is the same, namely to provide a circumferential extending seal member which bears resiliently in a radial direction against the face of the facing structures and blocks axial flow around the outside edges of body 40.

According to the invention, at the free end of leaf segment 144, wear shoe 142 is attached by means of an angle section 162 and a through bolt 164, threaded into the wear shoe 142. As the heat exchanger body rotates, the seal bears against inner surfaces of the housing. It is preferred to include an additional wear surface on the inner surface of the housing, by welding a wear strap around the line to be followed by the seal, especially if the wear surface is badly worn.

As shown in FIGS. 10 and 11, the circumferential seal segments are likewise adapted to overlap one another. Wear shoe 142, however, protrudes beyond the edge of the seal leaf 144, which differs from the sector seal embodiment, wherein the leaf protrudes beyond the wear shoe to lap the next successive leaf. In the case of the seal 140, the leaf segments 144 are not arranged to overlap, however, each leaf section at the angle iron 162 adjacent one end thereof, overlaps the wear shoe 142 of the next successive seal segment. In this manner, the plurality of seal segments defining the seal are adequately flexible yet safe from wear, and the seal adapts substantially to the contour of the surfaces over which the segment slide.

The circumferential seal prevents air by passing the heat exchange body, in a wear-resistant manner. It is not necessary according to the invention to replace the entire circumferential if only the shoe becomes worn. The leaf segment can be saved, and the seal replaced when the wear shoe and angle iron are worn down to a point approaching the hole for the angle bolt 164, which passes through the angle iron into the wear shoe to attach the respective parts together. The invention according to this embodiment, avoids the problem with many prior art seals characterized by thin edgewisebearing members that tend to hook under protrusions and the like which occur around the surface to be sealed.

Whereas the basic part of the seal, namely the weld bar by which the circumferential seal is attached to the heat exchanger body, is permanently attached, replacing the circumferential seal is relatively easy. The weld bar can be provided, for example, in increments carrying a plurality of circumferential seal segments thereon, for example a three foot section carrying thirteen 3 inch circumferential seal segments. In refurbishing the circumferential seal, the operator is required to unbolt the old angle iron and wear shoe and to replace them. Nevertheless, this is much less complicated than replacing the overall seal. The worn seals could also be returned to the manufacturer for repair.

Figure 12:
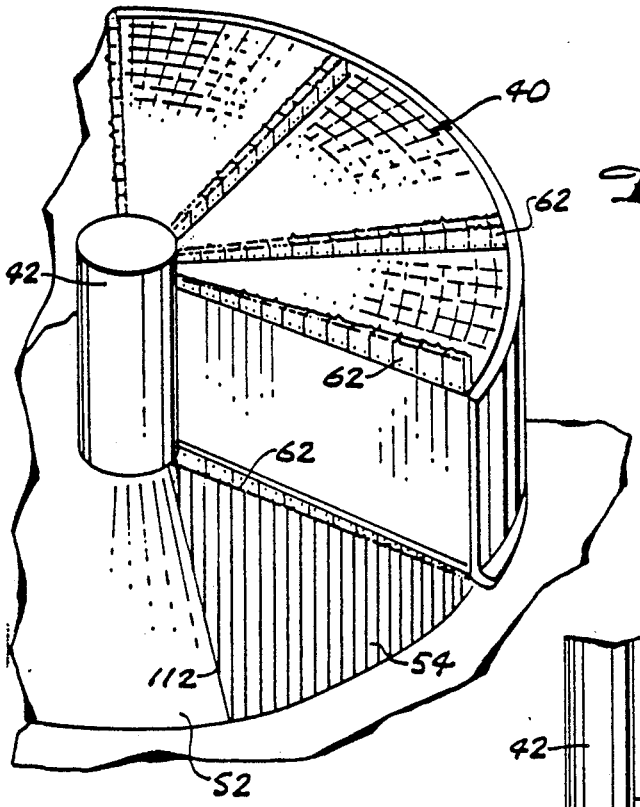
FIGS. 12, 13 and 14 are schematic illustrations of method steps for replacing a seal according to the invention.

In addition to conveniences provided by means of the circumferential seal according to the invention, refurbishing the radial or sector seals is likewise a straightforward operation. Furthermore, the sector seals according to the invention are particularly apt for replacing previously-installed worn sector seals, without replacing the entire seals. As shown in FIG. 12, a worn seal is likely to have a sloping configuration relative to the lower (or upper) edge of the heat exchanger body. This is due to the typical deformation of the heat exchanger body with heating, namely the radial outermost circumference droops downwardly from the central portions of the heat exchanger body. As a result, the seal fails first at its outer edges. In order to replace the seal, it would be possible to install a seal directly along the lower edge of the heat exchanger body, however, it is also necessary to align the seal properly to reflect the dimensional variations which occur with heating. These dimensional variations may be substantial, and the only accurate way to measure the position of the heat exchanger body with heating is to make such measurements when the device is in operation, which is impractical.

According to the invention, a replacement seal, particularly a radial or sector seal according to the invention, is installed without the necessity to make measurements of the dimensional variations of the heat exchanger body such that the gap at various temperatures between the heat exchanger body and the housing can be assessed. Instead, the extent of wear on the seal to be replaced is used for the purpose of aligning the new seal.

FIG. 12 shows a worn seal to be replaced, the worn seal being substantially shorter at the radial outside of the heat exchanger body due to typical sagging of the body with temperature. The outside edges also pass over a greater linear distance than the inside edges. An opposite wear situation occurs at the upper edge, where typical wear is less at the outside edge due to sagging (these variations assume that the heat exchanger is centrally supported and rotating on a vertical axis) Similar uneven wear patterns occur with horizontal shaft heat exchangers. By way of the invention, the seal is mounted by means of bolts in an intermediate section of the worn seal, such that the free edge of the seal is substantially parallel to the worn edge. Accordingly, without the need for measurements, the new seal is easily mounted, correctly aligned and properly placed in operation with a minimum of down time.

Figure 13:
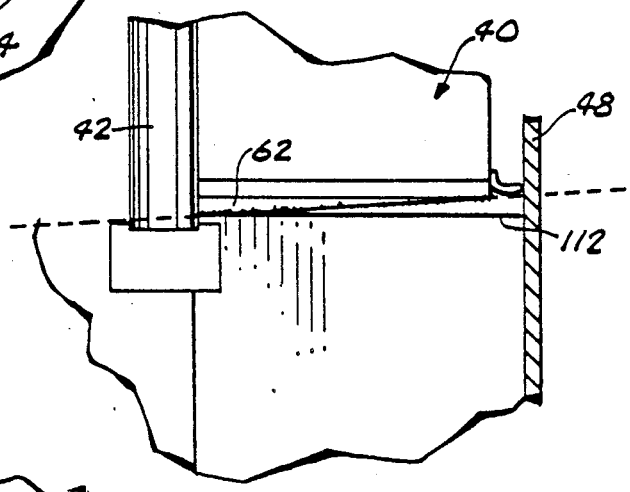
Figure 14:
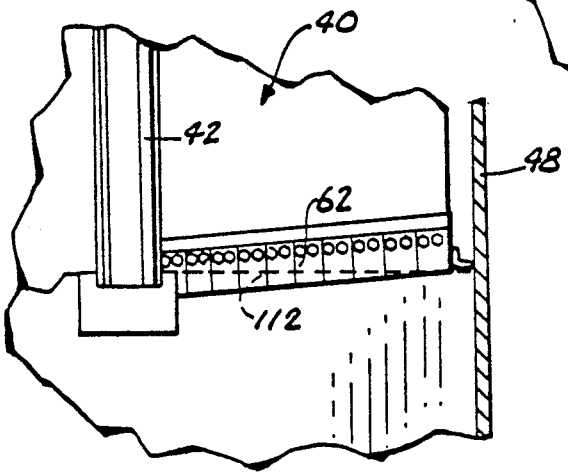

The steps involved, as illustrated in FIGS. 12–13 are to assess the line of wear of the seal, for example by placing a marker along the edge of the sector opening parallel to the remaining edge of the worn seal, which may typically slope up or down. The lower edge of the worn seal can then be removed, or simply trimmed such that it extends continuously across the heat exchanger body. The new, segmented seal according to the invention is then bolted directly to the web of the original worn-out seal, parallel to the edge of the worn seal which remained prior to thinning, thereby avoiding the need for measurements, welding or other complex and time consuming procedures.

In accordance with the foregoing disclosure, the invention herein is a seal 62 or 66 for a regenerative heater of the type having a heat retaining body 30 sealably movable in a housing 48 defining a hot flow path 32 and a cool flow path 34 through the housing 48, and means for placing at least a portion of the heat retaining body 30 placing said portion across the hot flow path 32, whereupon the heat retaining body 30 is heated then across the cool flow path 34, whereupon the heat retaining body gives up heat, the seal comprising a plurality of serially-connected seal segments 70, 140 attached to one of the body 30 and the housing 48, the seal segments each extending along a seal line and overlapping one another along the seal line, the seal segments bearing against the other of the body and the housing to effect a seal between the body and the housing.

The body 30 can be an open celled cylinder rotatable in the housing on an axis 42 and the hot and cool flow paths can be substantially parallel to the axis and arranged to intersect angular sectors of the cylinder 30, spaced radially around the axis, said seal line being one of a sector seal 62 aligned substantially on a radial seal line bounding one of said sectors and a circumferential seal 66, aligned substantially on a circumferential seal line blocking flow along a radial outside of the cylinder 30.

Preferably, the device has both a plurality of sector seals 62 and at least one circumferential seals 66, each having said serially connected and overlapping segments 70, 140. Each seal segment has a wear shoe 72 or 142 and a segment leaf 74 or 144, the segment leaf being a section of sheet material attachable to protrude from one of said heat retaining body and said housing 48, and the wear shoe being a relatively thicker section of stock attached to the segment leaf along said seal line, one of the segment leaf and the wear shoe protruding beyond the other at a first edge of each associated segment to overlap a next successive segment.

The segment leaves of successive seal leaves along the seal line can overlap one another and protrude beyond their prespective wear shoes by an amount substantially equal to the overlap, whereby when at rest the wear shoes of the seal reside end to end and the segment leaves overlap. The seal segments can have a wear shoe on each opposite side thereof, said segment leaf protruding beyond its wear shoe on a first side of the segment leaf in one direction along the seal line and beyond its wear shoe on an opposite of said segment leaf in an opposite direction along the seal line. Means are preferably included to attach a plurality of serially connected said seal segments at leaf sections thereof to a seal leaf of an already-sealed heat retaining body, for example a worn seal.

At least one of the seals can be a radial sector seal 70 and the housing 48 can define at least one radially oriented abutment 112 encountered by the seal, the device further comprising a ramp 114 protruding from the abutment 112, the ramp 114 receiving the radial sector seal 70 along a line angularly preceding the abutment in a direction of rotation of the heat retaining body. One of the abutment and the sector seal can be oriented precisely on a radius from the axis 42, and the other can be oriented parallel to a radius from the axis but spaced therefrom, whereby the abutment and the sector seal intersect along a point progressing radially along the seal line as the heat retaining body is rotated. Preferably both the radial sector seal and the circumferential seal have overlapping elements including one of segment leaves and wear shoes. Preferably, the circumferential seal has a plurality of overlapping segment leaves and endwise-adjacent wear shoes each said segment leaf overlapping a next successive leaf and protruding from an associated wear shoe segment by an amount substantially equal to an overlap of the segment leaves. The circumferential seal preferably includes a backer element disposed on an opposite side of the segment leaf from the wear shoe, the wear shoe and the segment being attached together and to the backer element by at least two bolts threaded into the wear shoe through the backer element and the segment leaf. The backer element can include a flange strip extending over the segment behind the wear shoe and extending around the segment leaf to cover a free end of the seal at the wear shoe. A backer plate can be included over the flange strip, behind the wear shoe.

The seal for the regenerative heater preferably employs a seal leaf construction having a plurality of thicknesses of overlapping sheet material, a number of thickness of the sheet material being greater adjacent the mounting of the seal and fewer adjacent the free end thereof.

The invention also involves a method for refurbishing a worn seal and a regenerative heater of the type having a heat retaining cylinder movable in a housing defining a hot flow path and a cool flow path through the housing and through the cylinder, of the type described herein, the method comprising the steps of moving the radial seal to a boundary of a sector in the housing, and noting an axial position beyond a sealing plane of the sector seal on an inner surface of the housing, parallel to a free edge of the worn seal, removing excess portions of the worn seal, attaching a seal extension to the one seal such that the seal extension has a free edge which is parallel to said predetermined axial position as noted. The method further involves continuing with replacing seals in the aforesaid manner until all the radial seals on the upper and lower surfaces of a heat retaining body are replaced with new seals mounted along lines parallel to the worn edge of the worn seals.

The invention having been disclosed, a number of alternatives will now become apparent to persons skilled in the art. Reference should be made to the appended claims rather than the foregoing specification as indicating the true scope of the invention in which exclusive rights are claimed.

I claim:

1. A seal for a regenerative heater of the type having a heat-retaining body sealably movable in a housing defining a hot flowpath and a cool flowpath through the housing, and means for placing at least a portion of the heat-retaining body across the hot flowpath, whereupon the heat-retaining body is heated, and then placing the portion across the cool flowpath, whereupon the heat-retaining body gives up heat, the seal comprising:

a plurality of serially connected flexible seal segments fixedly attached to one of the body and the housing, the seal segments each extending along a seal line and overlapping one another along the seal line, the seal segments bearing against the other of the body and the housing to effect a seal between the body and the housing, the seal segments each having a wear shoe and a segment leaf, the segment leaf including a portion of relatively more flexible material attachable to protrude from one of said heat-retaining body and said housing, and the wear shoe including a portion of relatively more rigid material disposed at an edge of the segment leaf along said seal line, one of the segment leaf and the wear shoe protruding beyond the other at a first edge of each associated segment to overlap a next successive segment.

2. The seal for a regenerative heater according to claim 1, wherein the body is an open celled cylinder rotatable in the housing on an axis and the hot and cool flowpaths are substantially parallel to the axis and intersect angular sectors of the cylinder disposed around the axis, said seal including at least one of a sector seal aligned substantially on a radial seal line bounding one of said sectors and a circumferential seal aligned substantially on a circumferential seal line blocking flow along a radial outside of the cylinder.

3. The seal for a regenerative heater according to claim 2, comprising sector seals and a circumferential seal, at least one of said sector seals and said circumferential seal having said serially connected and overlapping segments.

4. The seal for a regenerative heater according to claim 3, wherein both the radial sector seal and the circumferential seal have overlapping segment leaves and wear shoes.

5. The seal for a regenerative heater according to claim 2, wherein at least one of the seals is a radial sector seal and the housing defines at least one radially oriented abutment encountered by the seal, and further comprising a ramp protruding from the abutment, the ramp receiving the radial sector seal along a line angularly preceding the abutment.

6. The seal for a regenerative heater according to claim 5, wherein one of the abutment and the sector seal is oriented precisely on a radius from the axis and the other of the abutment and the sector seal is oriented parallel to a radius from the axis and is spaced therefrom, whereby the abutment and the sector seal intersect at a point proceeding radially along the seal line.

7. The seal for a regenerative heater according to claim 2, comprising a circumferential seal with a plurality of overlapping seal segment leaves and endwise-adjacent wear shoes, each said segment leaf overlapping a next successive segment leaf and protruding from an associated wear shoe segment by an amount substantially equal to an overlap of the segment leaves.

8. The seal according to claim 7, wherein the circumferential seal bears radially outwardly between the body and the housing.

9. The seal according to claim 7, wherein the circumferential seal bears radially inwardly between the body and the housing.

10. The seal for a regenerative heater according to claim 2, further comprising a backer element disposed on an opposite side of the segment leaf from the wear shoe, the wear shoe and the segment leaf being attached together and to the backer element by at least two bolts threaded into the wear shoe through the backer element and the segment leaf.

11. The seal for a regenerative heater according to claim 10, wherein the backer element includes a flange strip extending over the segment leaf behind the wear shoe and extending around the segment leaf to cover a free end of the seal at the wear shoe.

12. The seal for a regenerative heater according to claim 13, wherein the backer element further comprises a backer plate over the flange strip, behind the wear shoe.

13. The seal for a regenerative heater according to claim 2, wherein the seal leaf comprises a plurality of thicknesses of overlapping sheet material, a number of thicknesses of the sheet material being greater adjacent the body and fewer adjacent the wear shoe.

14. The seal for a regenerative heater according to claim 1, wherein the segment leaf is a section of sheet material, and the wear shoe is a section of bar stock.

15. The seal for a regenerative heater according to claim 14, wherein the segment leaves of successive leaves along the seal line overlap on another and protrude beyond their respective wear shoes by an amount substantially equal to the overlap, whereby when at rest the wear shoes of the seal reside end to end and the segment leaves overlap.

16. The seal for a regenerative heater according to claim 14, wherein the seal segments each have a wear shoe on both opposite sides, said segment leaf protruding beyond its wear shoe on a first side of the segment leaf in one direction along the seal line and beyond a its wear shoe on an opposite side of said segment leaf in an opposite direction along the seal line.

17. The seal for a regenerative heater according to claim 14, further comprising means to attach said plurality of serially connected seal segments at leaf segments thereof to a seal leaf of an already-sealed heat retaining body.

18. The seal according to claim 14, wherein the wear shoe includes a section of bar stock removably and replaceably bolted to the leaf.

19. The seal according to claim 1, wherein the segment leaves of each of said seal segments are fixedly attached to said one of the body and the housing by attachment directly to a worn seal thereon.

20. The seal according to claim 1, wherein adjacent ones of the seal segments are overlapped such that a trailing edge of each said segment in a direction of motion of the seal is disposed under a leading edge of a next successive segment, whereby the seal segments lift one another over obstructions.

* * * * *